United States Patent [19]

Wahlström

[11] 4,191,314

[45] Mar. 4, 1980

[54] DEVICE FOR OPENING AND CLOSING CARGO POCKET BOTTOM OUTLETS FOR BULK CARGO

[75] Inventor: Åke E. T. Wahlström, Enköping, Sweden

[73] Assignee: AB Nordstroms Linbanor, Enköping, Sweden

[21] Appl. No.: 837,414

[22] Filed: Sep. 28, 1977

[30] Foreign Application Priority Data

Oct. 4, 1976 [SE] Sweden ..... 7610984

[51] Int. Cl.[2] ..... B63B 27/04

[52] U.S. Cl. ..... 222/506; 49/136; 105/240; 414/144

[58] Field of Search ..... 214/15 R, 15 D, 15 E, 214/16 R; 298/24, 27, 28; 105/240, 282 R, 282 A, 282 P; 222/504, 505, 506; 49/136, 16, 20; 414/144, 145

[56] References Cited

U.S. PATENT DOCUMENTS

| | | | |
|---|---|---|---|
| 1,122,273 | 12/1914 | Hansen | 298/27 X |
| 2,816,797 | 12/1957 | Hanson | 105/282 R X |
| 3,191,998 | 6/1965 | Howlett | 214/15 D X |
| 3,458,238 | 7/1969 | Larssen | 105/282 R X |
| 3,489,296 | 1/1970 | Snow | 214/15 D |
| 3,561,368 | 2/1971 | Giesking | 105/282 X |

*Primary Examiner*—Frank E. Werner

*Attorney, Agent, or Firm*—Cushman, Darby & Cushman

[57] ABSTRACT

A device for opening and closing bottom outlets of a plurality of cargo pockets arranged in rows, preferably in holds in bulk cargo ships, conveyors being arranged beneath the pockets. A guide arrangement extends longitudinally along the bottom of a row of pockets and carries covers for the bottom outlets of the pockets. Said covers are journalled for horizontal movement in the longitudinal direction of the guide arrangement between opened and closed positions. At least one carriage can be moved parallel to said guide arrangement and can be driven forward to an arbitrary cover. Said carriage is provided with a drive movable from an inoperative position to a position in which they are engaged with the chosen cover in order to, during subsequent movement of the carriage in either direction, move the cover to an open or closed position. Then the drive can be moved to the inoperable position in order to allow the movement of the carriage to another cover.

11 Claims, 3 Drawing Figures

DEVICE FOR OPENING AND CLOSING CARGO POCKET BOTTOM OUTLETS FOR BULK CARGO

BACKGROUND

The present invention relates to a device for opening and closing bottom outlets of a plurality of cargo pockets arranged in rows, preferably in holds in bulk cargo ships, conveyors being arranged beneath the pockets.

In so called self-unloading bulk cargo ships in which the bulk cargo is emptied down onto conveyor belts situated below the holds for further transport to conveyors leading out from the ship, the bottom portion of the holds is usually designed so that it forms a plurality of V-shaped pockets extending in both the fore-and-aft and thwartships directions. Each pocket has an outlet opening which enables 100% emptying of the holds without requiring any extra measures. In a known embodiment, the outlets are sealed by pivotably journalled tapping chutes or spouts operated by hydraulic cylinders which, in a raised position, seal the outlet of the pocket and which, in a lowered position, expose the outlet and lead the material down to the underlying conveyor belt. Beyond 100% emptying, the large number of load pockets which can be individually emptied makes it possible to keep the ship correctly trimmed during unloading.

However, one disadvantage of the described arrangement is that it is very expensive to install. As an example, it can be mentioned that bulk cargo ships of approx. 20,000 tdw can have up to 80 load pockets, each of which is provided with a tapping spout with accompanying hydraulic cylinders, conduits and valves. Due to this, service and maintanance work becomes demanding and costs are high. Another disadvantage is that the inverted V-shaped ridges running in the fore-and-aft and thwartships direction between the pockets must be relatively large in order to provide space for the underlying equipment. This results in that the cargo space is reduced.

SUMMARY OF THE INVENTION

The purpose of the present invention is to obtain a device of the kind disclosed in the introduction which is considerably simpler and less expensive than the known device as regards both installation and service and which furthermore allows better usage of the space available in the ship.

According to the invention, this is achieved by means of a guide arrangement which extends longitudinally along the bottom of the row of pockets and carries covers for the bottom outlets of said pockets, said covers being journalled for horizontal movement in the longitudinal direction of the guide arrangement between opened and closed positions, and at least one carriage which can be moved parallel to said guide arrangement and can be driven forward to an arbitrary cover, said carriage being provided with driving means which are movable from an inoperable position to a position in which they are engaged with the chosen cover in order to, during subsequent movement of the carriage in either direction, move the cover to an open or closed position, after which the driving means can be moved to the inoperable position in order to allow movement of the carriage to another cover.

By means of the invention, the need for providing the outlet of each pocket with complicated pivotable sealing devices regulated by power-driven means, for example hydraulic cylinders, is eliminated. Instead, simple, merely movable covers and a common opening and closing arrangement for several covers in a row in the form of a movable carriage is used. By means of this simple design, especially the inverted V-shaped ridges running in the thwartships direction between the pockets can be designed to be considerably smaller. This increases effective cargo space.

In an especially advantageous embodiment of the invention, the carriage has a frame provided with wheels, a raisable and lowerable shuttle arranged on and longitudinally movable on said frame, said shuttle carrying the driving means, and a drive arrangement in the form of at least one drive chain or line running parallel to the guide arrangement and running over a first wheel driven by a drive motor and a second wheel which is movable in the longitudinal direction of the guide arrangement by means of a tension device, one end of the drive chain or line being connected to the frame, the other end of said line being connected to the shuttle, said frame and shuttle having cooperating means which, when the second wheel is moved away from or towards the first wheel, cause raising or lowering of the shuttle, the driving means being arranged on the shuttle in such a way that they can be moved into engagement with the chosen cover when the shuttle is raised.

The principle design of the carriage itself is previously known in connection with so called RBC-systems (Running Beam Conveying systems) for pure transport purposes in which the shuttle of the carriage is designed to have lifting beams intended to lift goods and carry the goods during transport. During the development of the present invention, it was found that these carriages which to date have only been intended for transport purposes have properties which can be used to achieve considerable advantages in the invention as compared to the use of carriages carrying electric or hydraulic driving equipment and control equipment for the driving means. Thus, a simple, totally mechanical and robust carriage construction without any easily-damaged details which can be damaged by the goods falling down from the pockets is obtained. The drive machinery and the tension arrangement are both stationary and can be placed in protected places outside of the pockets. Maintenance and repair work becomes easy to carry out so that they can also be carried out when the ship is sailing.

DETAILED DESCRIPTION

Further characteristics and advantages of the invention will be revealed in the following description. Reference is made to the enclosed drawings showing examples of the invention, where FIG. 1 is a schematic longitudinal section of a ship hold having an arrangement according to the invention, FIG. 2 is an enlargement of the framed-in area II in FIG. 1 (longitudinal section), and FIG. 3 is a cross section along the line III—III in FIG. 2.

Figure 1:
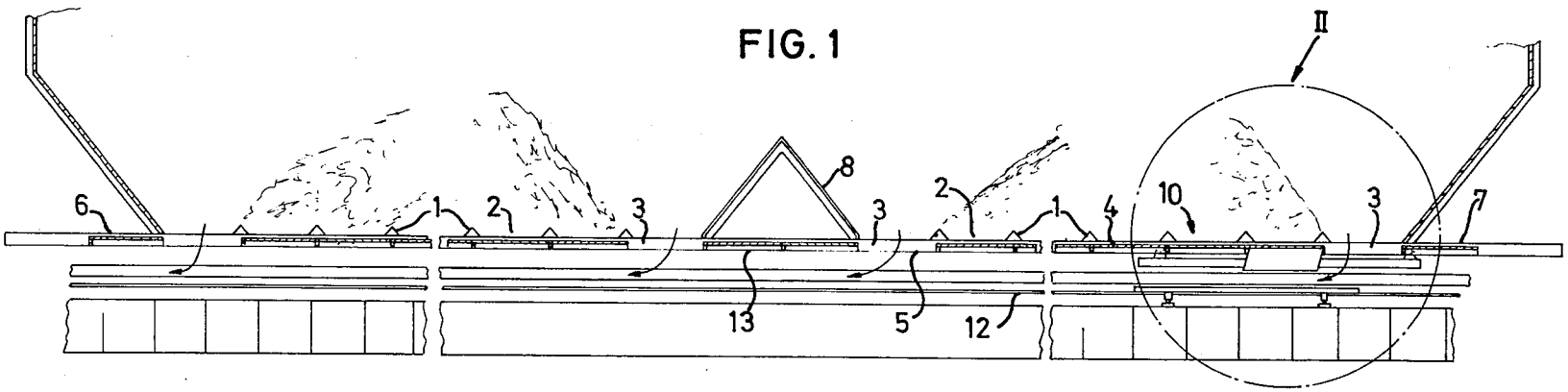

The bottom of the hold shown in FIG. 1 is provided with ridges running in the fore-and-aft and thwartships directions. Only the thwartships ridges 1 are shown in FIG. 1. Pockets 2 formed between the ridges have bottom outlets 3 which can be sealed by covers 4. Said covers are movably jounalled in a common guide 5 which extends along the entire row of pockets 2. The guide 5 has end portions 6 and 7 which project beyond the row of pockets in order to carry a cover 4. An enlarged transverse ridge 8 is arranged in between and at an equal distance from both of the ends of the guide 5, the fore-and-aft direction extension of which corresponds to the length of two covers 4. The covers 4 to the right of the ridge 8 can be opened and closed by means of a carriage generally numbered 10, said carriage having wheels running in the guide 5 and raisable and lowerable driving means for the covers. The carriage, whose construction and function shall be described in more detail below with reference to FIGS. 2 and 3, is movable in order to serve the row of covers 4 to the right of the ridge 8. A corresponding carriage (not shown here) serves the row of pockets to the left of the ridge 8.

In FIG. 1, the pockets 2 at the outer ends of the row and closest to the ridge 8 are shown with their bottom outlets 3 open to discharge the goods to an underlying belt conveyor 12, accompanying covers 4 of the respective carriages 10 being inserted in the end sections 6 and 7 of the guide and section 13 under the ridge 8. The bottom outlets 3 of the other pockets are thereafter opened successively one-by-one, each respective cover 4 being pushed underneath the outlet of an adjacent, previously emptied pocket as shall be described below.

Figure 2:
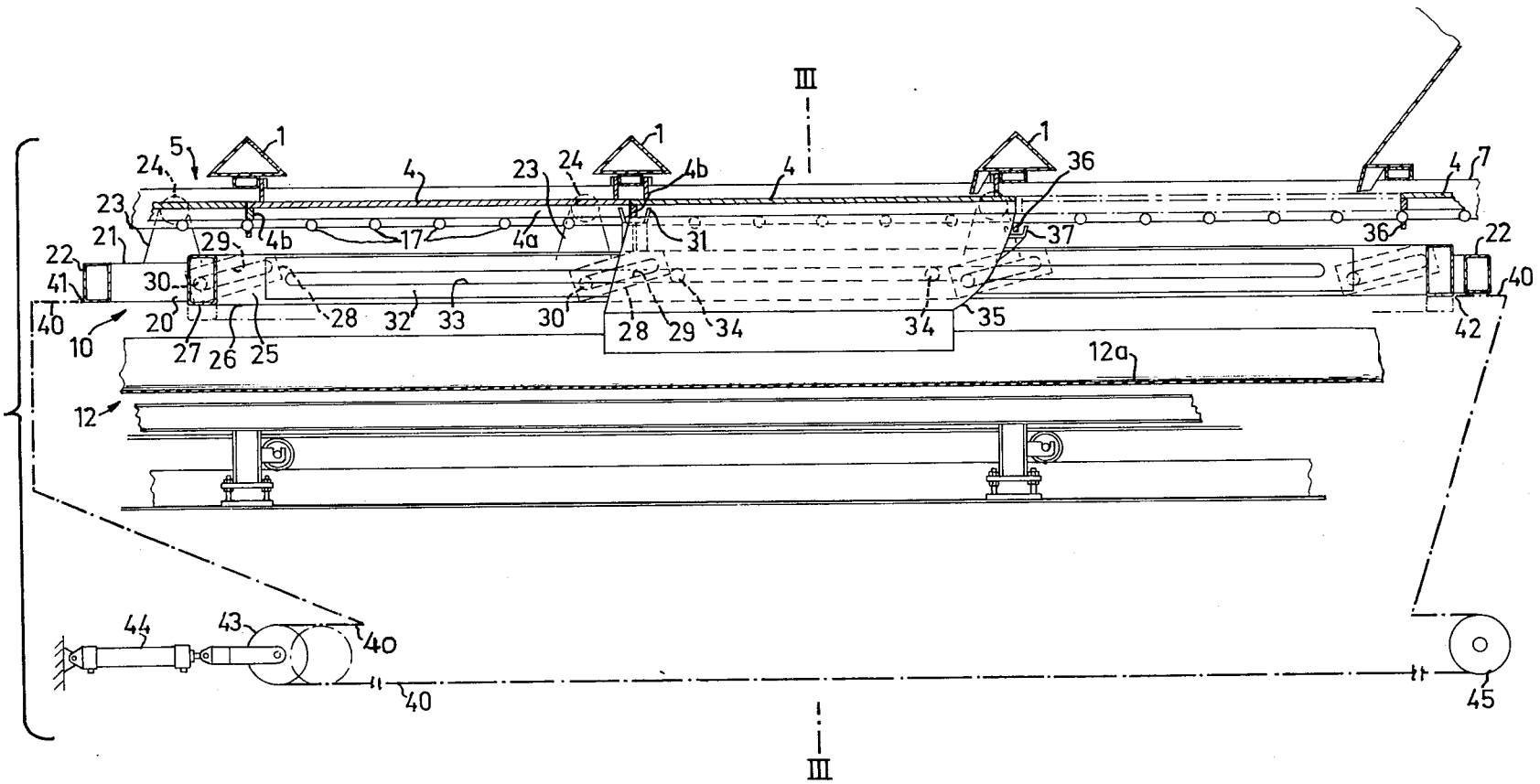
Figure 3:
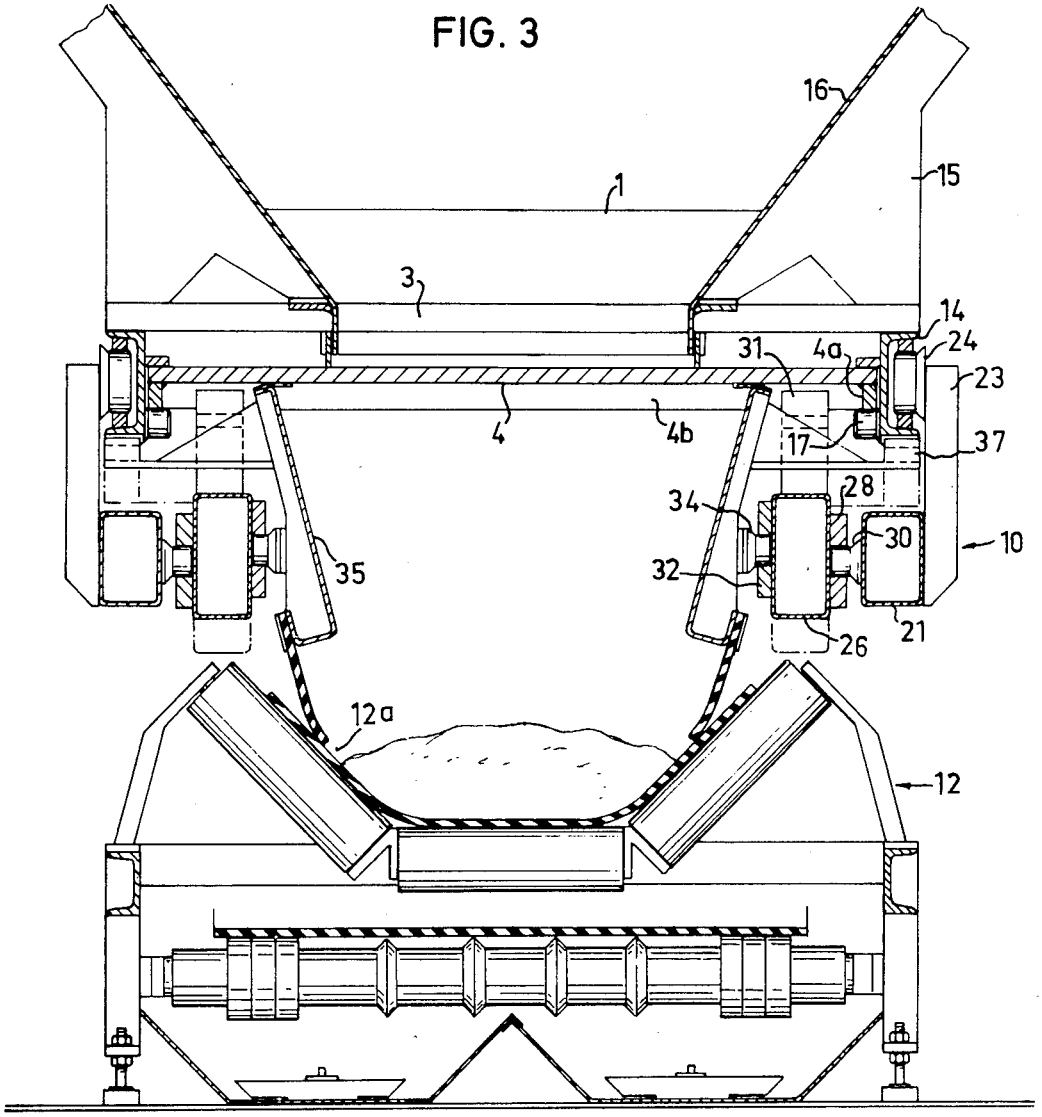

FIGS. 2 and 3, a section of the guide 5 and the carriage 10 are shown in enlargement. The former consists of two parallel U-beams 14 which are attached by means of consoles 15 to ridges 16 extending in the fore-and-aft direction of the hold on both sides of the outlet 3 of the pockets 2. A plurality of rotatably-journalled rollers 17 are arranged on the U-beam 14 sides which are facing each other, on which rollers longitudinal edge flanges 4*a* of the covers 4 rest. In their closed position, the covers lie with their end edges abuting each other so that they form a continuous, openable bottom for the row of pockets between the end sections 6 and 7 and middle section 13 of the guide. As is revealed in FIG. 2, one end edge of the covers 4 has a downwardly-directed flange 4*b* while the other edge of the covers lacks a corresponding flange.

The carriage 10 has a frame 20 comprising longitudinal and transverse frame beams 21 and 22. Upwardly-directed support consoles 23 are attached to each beam 21, the wheels 24 of the carriage being rotatably-journalled in the upper end of the same and resting on the bottom horizontal flange of the U-beams 14 of the guide. The frame supports a shuttle 25 comprising longitudinal and transverse frame beams 26 and 27. The outer side of each longitudinal frame beam 26 carries four plates 28, each of which has an inclining cam recess 29. Rollers 30 are rotatably journalled on the frame beams 21 of the frame, said rollers each engaging in a respective cam recess 29. By means of this arrangement, the shuttle 25 can be longitudinally moved in relation to the frame 20 while simultaneously being moved vertically so that driving means 31 arranged on the shuttle can be moved into and out of engagement with the downwardly-directed end flange 4*b* of the covers. This is especially illustrated in FIG. 2.

The inner side of the longitudinal beam 26 of the shuttle 25 have an elongated plate 32 having a horizontal slot 33 which extends over the greater portion of the length of the beams 26. Wheels on an outlet spout or loading box 35 are arranged in the slot. The spout or box 35 has the function of leading the goods from the pockets 2 down onto the conveyor belt 12*a* of the underlying conveyor 12 and, when the shuttle 25 is in its raised position, lies tightly below the outlet of the pockets as shown in FIGS. 2 and 3. Each pocket has a locking boss 36 fixed onto the guide 5, said boss, in this position, engaging between the flanges on a stop 37 connected to the spout or box 35.

FIG. 2 also schematically illustrates drive equipment for moving the carriage 10 along the guide and for lifting and lowering the shuttle 25 in relation to the frame 20. Said drive equipment comprises a pair of chains or lines (one shown) 40, one end of which is attached at 41 to the frame 20, the other end being attached at 42 to the shuttle 25. Each chain passes over a horizontally-movable tension wheel 43 which is connected to a piston-cylinder device 44 for pressurized medium, and over a drive wheel 45 which is connected to a drive motor (not shown here). In FIG. 2, the tension wheel 43 is shown with solid lines in the position where the chains 40 are stretched so that the frame 20 is displaced to the left in relation to the shuttles 25 as seen in FIG. 2, and the shuttle 25 is raised to its uppermost position. During the actual stretching of the chains 40, the drive wheels 45 are braked. During subsequent driving of the drive wheels 45, the carriage is moved along the guide 5 with the shuttle in the shown position. When the tension wheel is moved to the position illustrated by broken lines, the shuttle 25 is lowered so that the driving means 31 and the stops 37 are moved out of engagement with the cover flange 4*b* and the locking boss 36.

The tension wheels 43 and the drive wheels 45 with associated piston-cylinder device 44 and the drive motor—which are all only illustrated schematically in FIG. 2—are, in practice, positioned so that they are protected from falling goods in the area at the outer end of the guide 5 and below the transverse broad ridge 8.

In FIG. 2, the middle and right-hand pockets 2 of the three pockets shown are emptied. The carriage has just closed the cover 4 of the middle pockets which was just emptied. This is necessary in order to center the box 35 on the carriage, as shall be explained below. The cover of the right-hand pocket is pushed into guide section 7.

Starting from the shown position, the working cycle for emptying the left-hand pocket is as follows.

The chains 40 are slackened by means of the tension wheel being moved to the right-hand position, whereby the shuttle 25 is lowered. The drive wheel is started so as to move the carriage 10 to the left one cover length. Braking the drive wheel, the chain 40 is thereafter stretched, whereby, the frame 20 is moved to the left in relation to the shuttle 25 which is hereby raised so that the driving means 31 is moved into engagement with the end flange 4*b* of the left-hand cover 4. At the same time, the box 35 is brought into contact with the bottom side of the cover and its stop 37 is moved into engagement with the stop 36. The drive wheel 45 is now driven in the opposite direction so that the carriage 10 is moved one cover length to the right. This causes the left-hand cover 4 to move to the right and assume the position of the middle cover which, in turn, is moved into the "free" space below the first pocket by the left-hand cover. During this movement, the box 35 is fixed under the left-hand pocket and its wheels 34 roll in the slots 33 in the shuttle 25. As the box 35 is now situated at the left end of the carriage 10, it must—after emptying of the pocket—once again be centered on the carriage before the next pocket can be emptied. This takes place by means of the carriage being driven back to the left one cover length, whereby the outlet of the left-hand pocket is closed. The cover of the middle pocket is then left below the right-hand pocket, which entails that a "free" space is now obtained below the middle pocket. Subsequently, during the continued opening sequence, the "free" space is moved one step to the left each time, and except for when the first cover is opened, the carriage moves two covers each time. However, only one of said latter covers is loaded with goods lying above the same.

In the installation shown in FIG. 1, the pockets are opened alternately from the middle and from the ends of the hold in order to keep the ship trimmed during unloading. After unloading, the now unloaded covers can be returned to the closed position in long rows from the ends or the middle of the row of pockets or both depending on the opening sequence so that only a few closing operations are required.

The carriages 10 can be controlled by a computer in which the cover opening sequence is programmed. Furthermore, the box 35 can be provided with a flow indicator (not shown here) which indicates when a pocket is emptied and provides a signal for moving the carriage to the pocket which is to thereafter be emptied. The drive machinery preferably has two speeds; a higher speed for quick movement of the carriage between, for example, pockets at a distance from each other, and a slower speed for the actual opening and closing sequence.

As bulk cargoes such as, for example, cement klinker, are very dusty, the box 35 can be equipped with a vacuum nozzle which, when the box is brought into contact with a pocket, is inserted into a suction conduit which extends along the entire row of pockets. The inlets are preferably provided with a valve flap which is automatically opened when the nozzle is inserted.

The invention has been described above in connection with use in a bulk cargo ship, but, of course, is not restricted to only such use. Rather, it can also be used in stationary containers whose bottom is designed as rows of pockets having individual outlets.

What I claim is:

1. Apparatus for opening and closing bottom outlets of a plurality of cargo pockets which are arranged in rows and beneath which conveyors are arranged, said apparatus comprising a guide arrangement extending longitudinally along the bottom of a row of pockets and carrying covers for the bottom outlets of the pockets, means mounting said covers for horizontal movement in the longitudinal direction of the guide arrangement between opened and closed positions, and at least one carriage movable in either direction parallel to said guide arrangement into a position adjacent a selected cover, said carriage being provided with driving means which are movable from an inoperative position to a position in which they are engaged with the selected cover in order to, during subsequent movement of the carriage in either direction, move the selected cover to an open or closed position, after which the driving means can be moved to the inoperable position in order to allow the movement of the carriage to another cover said carriage including a frame provided with wheels, a raisable and lowerable shuttle arranged on and longitudinally movable on said frame, said shuttle carrying said driving means, and a drive arrangement in the form of at least one drive chain or line running parallel to the guide arrangement and running over a first wheel driven by a drive motor and a second wheel which is movable in the longitudinal direction of the guide arrangement by means of a tension device, one end of the drive chain or line being connected to the frame, the other end of said chain or line being connected to the shuttle, said frame and shuttle having cooperating means which, when the second wheel is moved away from or towards the first wheel, cause raising or lowering of the shuttle, said driving means being arranged on the shuttle in such a way that they can be moved into engagement with the selected cover when the shuttle is raised.

2. Apparatus as in claim 1 including a raisable and lowerable outlet spout or loading box horizontally movably journalled on the carriage in a manner such that said spout or box, when the driving means is moved into engagement with a cover, is raisable to an abutment position beneath the cover, said apparatus further including locking means engaging with stationary stops so that the spout or box is fixed below the outlet of the pocket during subsequent movement of the carriage and displacement of the cover.

3. Apparatus as in claim 2 wherein the outlet spout or loading box is provided with wheels which run in slots in the shuttle, said slots extending longitudinally over a greater portion of the length of said shuttle.

4. Apparatus as in claim 3 wherein the covers lie in the same plane and have the same extension in the longitudinal direction of the guide arrangement, that the end edges of the covers of adjacent pockets are situated adjacent to each other or at a negligible distance from each other when the covers are closed, said guide arrangement having at least one portion which extends across an area not having any bottom outlet and whose length is at least the same as the length of a cover so that the cover of a bottom outlet adjacent to said portion can be pushed into said portion, after which the cover of the following bottom outlet can be pushed into the area of said first bottom outlet.

5. Apparatus as in cliam 4 wherein at each end of the row of pockets, the guide arrangement has a portion which projects outside of the respective end pockets a distance which is at least the same as the length of a cover, and wherein there is an area in the middle of the row of pockets, said area lacking a bottom outlet and extending over an area corresponding to at least two cover lengths, two carriages being arranged to open and close the bottom outlets on their respective sides of the outlet-free middle area of the rows of pockets.

6. Apparatus as in claim 5 wherein said carriage includes wheels, wherein the guide arrangement comprises two beams situated on respective sides of the bottom outlets of the pockets and attached to the bottom edge of said pockets, the sides of said beams facing each other having a plurality of rollers which are evenly spaced along the length of said beams, the longitudinal edges of the covers resting on said rollers, and wherein the sides of the beams which are facing away from each other have horizontal flanges which form rails for the wheels of said carriage.

7. Apparatus for opening and closing bottom outlets of a plurality of cargo pockets which are arranged in rows and beneath which conveyors are arranged, said apparatus comprising a guide arrangement extending longitudinally along the bottom of a row of pockets and carrying covers for the bottom outlets of the pockets, means mounting said covers for horizontal movement in the longitudinal direction of the guide arrangement between opened and closed positions, and at least one carriage movable in either direction parallel to said guide arrangement into a position adjacent a selected cover, said carriage being provided with driving means which are movable from an inoperative position to a position in which they are engaged with the selected cover in order to, during subsequent movement of the carriage in either direction, move the selected cover to an open or closed position, after which the driving means can be moved to the inoperable position in order to allow the movement of the carriage to another cover, a raisable and lowerable outlet spout or loading box horizontally movably journalled on the carriage in a manner such that said spout or box, when the driving means is moved into engagement with a cover, is raisable to an abutment position beneath the cover, said apparatus further including locking means engaging with stationary stops so that the spout or box is fixed below the outlet of the pocket during subsequent movement of the carriage and displacement of the cover.

8. Apparatus as in claim 7 wherein the outlet spout or loading box is provided with wheels which run in slots in the shuttle, said slots extending longitudinally over a greater portion of the length of said shuttle.

9. Apparatus as in claim 8 wherein the covers lie in the same plane and have the same extension in the longitudinal direction of the guide arrangement, that the end edges of the covers of adjacent pockets are situated adjacent to each other or at a negligible distance from each other when the covers are closed, said guide arrangement having at least one portion which extends across an area not having any bottom outlet and whose length is at least the same as the length of a cover so that the cover of a bottom outlet adjacent to said portion can be pushed into said portion, after which the cover of the following bottom outlet can be pushed into the area of said first bottom outlet.

10. Apparatus as in claim 9 wherein at each end of the row of pockets, the guide arrangement has a portion which projects outside of the respective end pockets a distance which is at least the same as the length of a cover, and wherein there is an area in the middle of the row of pockets, said area lacking a bottom outlet and extending over an area corresponding to at least two cover lengths, two carriages being arranged to open and close the bottom outlets on their respective sides of the outlet-free middle area of the rows of pockets.

11. Apparatus as in claim 10 wherein said carriage includes wheels, wherein the guide arrangement comprises two beams situated on respective sides of the bottom outlets of the pockets and attached to the bottom edge of said pockets, the sides of said beams facing each other having a plurality of rollers which are evenly spaced along the length of said beams, the longitudinal edges of the covers resting on said rollers, and wherein the sides of the beams which are facing away from each other have horizontal flanges which form rails for the wheels of said carriage.

* * * * *